US008297640B2

(12) United States Patent
Ametsbichler

(10) Patent No.: US 8,297,640 B2
(45) Date of Patent: Oct. 30, 2012

(54) SNOW-SKI BOARD

(75) Inventor: Andreas Ametsbichler, Straubing (DE)

(73) Assignee: Marker Volkl International GmbH, Baar (CH)

( * ) Notice: Subject to any disclaimer, the term of this patent is extended or adjusted under 35 U.S.C. 154(b) by 516 days.

(21) Appl. No.: 12/461,265

(22) Filed: Aug. 5, 2009

(65) Prior Publication Data

US 2010/0052291 A1 Mar. 4, 2010

(30) Foreign Application Priority Data

Aug. 5, 2008 (DE) ..... 10 2008 036 390

(51) Int. Cl.
*A63C 5/07* (2006.01)

(52) U.S. Cl. ..... 280/602; 280/607

(58) Field of Classification Search ..... 280/601, 280/602, 607
See application file for complete search history.

(56) References Cited

U.S. PATENT DOCUMENTS

| | | | | |
|---|---|---|---|---|
| 7,360,782 | B2 | 4/2008 | Gignoux | |
| 2005/0006875 | A1 * | 1/2005 | Donze et al. | 280/602 |
| 2006/0151973 | A1 | 7/2006 | Quaggiotti | |
| 2007/0182129 | A1 * | 8/2007 | Wilson | 280/602 |
| 2010/0237588 | A1 * | 9/2010 | Krause et al. | 280/608 |

FOREIGN PATENT DOCUMENTS

| | | |
|---|---|---|
| DE | 10204330 | 8/2003 |
| WO | WO2004/016329 | 2/2004 |
| WO | WO2007/022923 | 3/2007 |

* cited by examiner

*Primary Examiner* — J. Allen Shriver, II
*Assistant Examiner* — Bridget Avery
(74) *Attorney, Agent, or Firm* — Welsh Flaxman & Gitler LLC

(57) ABSTRACT

Snow-ski board, especially a ski, having at least one trimming mechanism with at least one trimming rod with its axis oriented in the longitudinal direction of the snow-ski board, including at least one damping element and at least one adjusting or tensioning mechanism for supporting the trimming rod on both ends by adjustable mechanical tension.

14 Claims, 2 Drawing Sheets

SNOW-SKI BOARD

BACKGROUND OF THE INVENTION

The invention relates to a snow-ski board having at least one trimming mechanism with at least one trimming rod with its axis oriented in the longitudinal direction (L) of the snow-ski board. The trimming rod having at least one dampening element and at least one adjusting or tensioning mechanism for the trimming rod on both ends by adjustable mechanical tension wherein at least one tensioning mechanism is provided on a binding plate fastened on the snow-ski board body.

Snow-ski boards with trimming mechanisms for changing and/or adapting the characteristics, also the flexibility of the respective snow-ski board, is disclosed in the art (U.S. Pat. No. 7,360,782) and consist in the simplest case of a trimming rod provided in the snow-ski board body oriented in the longitudinal direction of the board and supported at both ends and compressed by a mechanical compressive force. By setting the compressive force, it is possible to change the characteristics of the snow-ski board by means of the trimming mechanism. Preferably the at least one trimming rod is supported axially by the use of at least one flexible damping element, preferably by the use a damping element that is both flexible and damping.

It is an object of the invention to present a snow-ski board having a simplified and extremely secure and operationally reliable design of the at least one trimming mechanism.

SUMMARY OF THE INVENTION

In the snow-ski board according to the invention, the adjusting or tensioning mechanism in the at least one trimming mechanism, with which the tensioning mechanism and the initial tension of the at least one trimming rod can be adjusted, is provided in the area of a binding plate, which is used for mounting the binding or its elements, preferably integrated in this binding plate. This results in a simplified design and assembly. The binding plate also serves as a counter support on the snow-ski board body side for the elements of the tensioning mechanism and ensures reliable anchoring of the tensioning mechanism on the snow-ski board body.

In a preferred embodiment of the invention, at least two separate trimming mechanisms are provided. A trimming mechanism is provided for the area of the snow-ski board body in front of the binding plate, i.e. for the area of the snow-ski board body extending between said binding plate and the front end of the snow-ski board body, and at least one further trimming mechanism is provided for the area of the snow-ski board body behind the binding plate, i.e. for the areas of the snow-ski board body extending between said binding plate and the rear end of the snow-ski board body.

Further embodiments, advantages and possible applications of the invention are disclosed in the following description of exemplary embodiments and in the drawings. All characteristics described and/or pictorially represented, individually or in any combination, are subject matter of the invention, regardless of their being summarized or referred to in the claims. The content of the claims is also included as part of the description.

BRIEF DESCRIPTION OF THE DRAWINGS

The invention is described below based on an exemplary embodiment with reference to the drawings, in which.

DETAILED DESCRIPTION OF THE INVENTION

Figure 1:
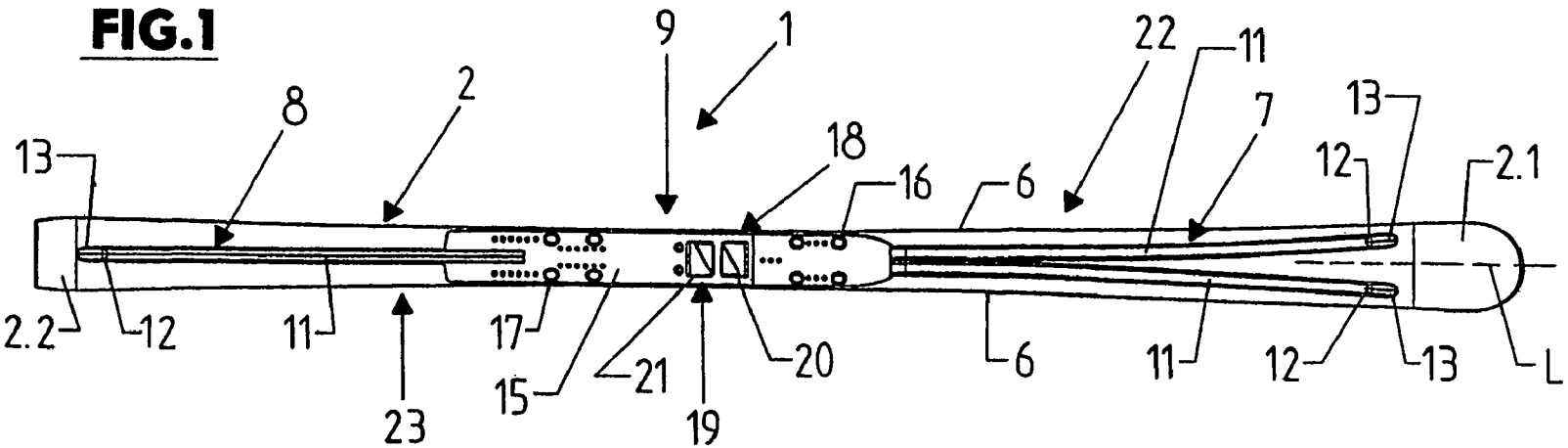
FIG. 1 shows a simplified representation in top plan view of a snow-ski board in the form of a ski.
Figure 2:
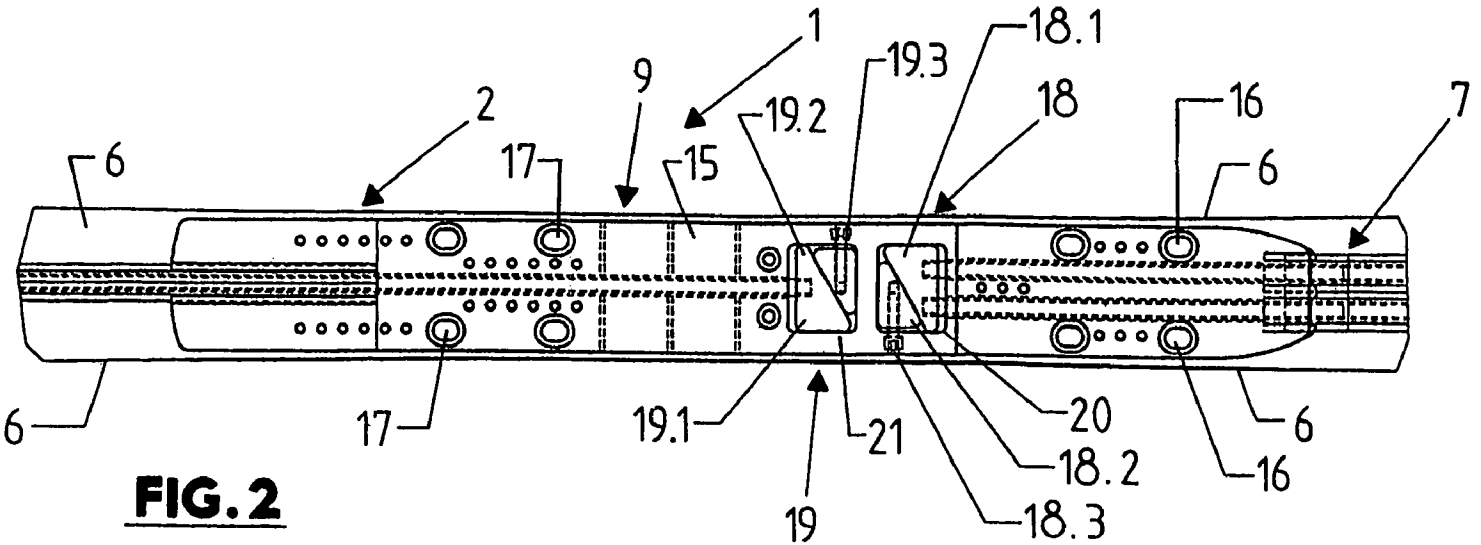
FIG. 2 shows the snow-ski board of FIG. 1 in an enlarged view of the binding area.
Figure 3:
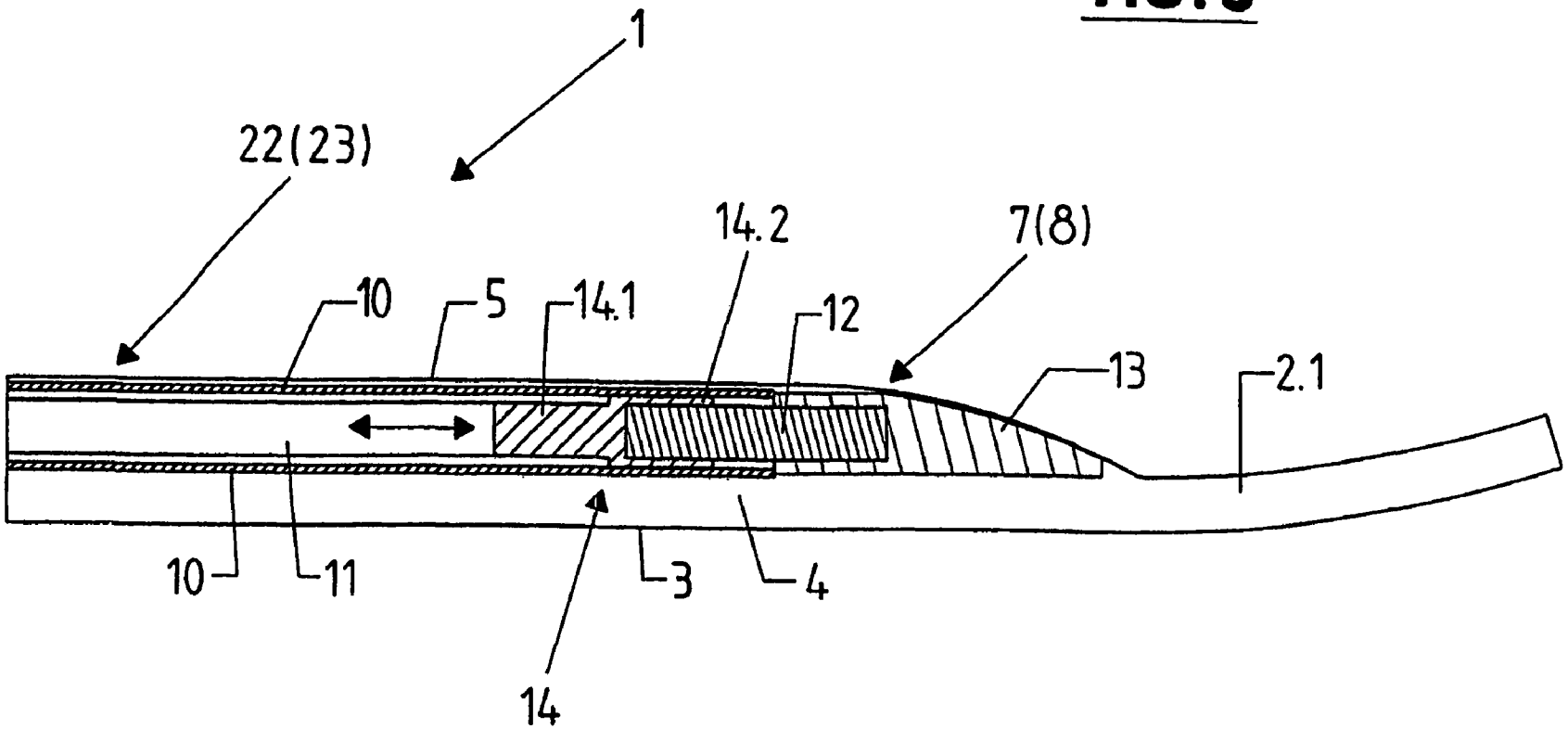
FIG. 3 shows a simplified view of a partial section of the snow-ski board of FIG. 1.

In the drawings, a snow-ski board 1 is depicted in the form of a ski (e.g. alpine ski). The snow-ski board 1 or its snow-ski board body 2 features, aside from special features described below, the usual design, i.e. including a bottom running surface component with the running surface 3 and with steel edges (not depicted), comprising a core 4 made of a suitable core material for snow-ski boards or skis (e.g. plastic foam and/or wood) with a torsion box, not depicted in the drawings, surrounding the core and made of a fiber-reinforced plastic and comprising a shell forming the top side 5 and the two longitudinal sides 6 of the ski or snowboard body 2. Further, the snow-ski board body 2 also includes supporting layers or belts, which extend in the proximity of the running surface 3 and the top side 5 of the snow-ski board body 2 over the entire length of the latter.

The snow-ski board 1 in the depicted embodiment is designed as an SD ski, i.e. the snow-ski board body 2 is provided on its top side 5 with a bead-shaped protrusion 7 and 8; the protrusion 7 extends starting from a middle area of the snow-ski board body or a binding area 9 in the snow-ski board longitudinal direction L all the way to the proximity of the front end of the snow-ski body 2.1 designed as a shovel and the protrusion 8 extends starting from the binding area 9 to the proximity of the rear end 2.2 of the snow-ski board body.

Within the protrusion 7, two channels 10 are provided beneath the shell forming the top side 5 with their longitudinal extension oriented respectively in the longitudinal axis L and made for example from plastic tube sections, the channels are arranged with their axes in a common plane parallel to the running surface 3 and diverge slightly starting from the binding area 9 following the reduction of the longitudinal sides 6. Within each channel 10, a trimming rod 11 is provided, axially movable, in the form of a carbon tube, i.e. in the form of a plastic tube reinforced with carbon fibers. Each trimming rod 11 is supported axially on its end away from the binding area 9 by means of a damping element 12 on a damping absorber 13 on the snow-ski board body side, into which the damping absorber stud-like damping element 12 engages with an end and which is accommodated within the snow-ski board body 2.

Further, each trimming rod 11 is provided on its end with a damping absorber 14 on the trimming rod side, which the damping absorber engages into the trimming rod 11 with a stud-like section 14.1 and forms a recess on its section 14.2 protruding over the trimming rod 11, into the recess, the stud-like damping element 12 engages with its other end. The damping absorbers 13 and 14 are, for example, preformed parts made of a suitable plastic or at least partially as turned parts made of a suitable material. The damping elements 12 are respectively preformed parts made of a damping, permanently elastic material, for example of an elastomer.

Also in the area of the protrusion 8, within the snow-ski board body 2, a channel 10 formed by a tube section is provided, into which the channel a trimming rod 11 is accommodated axially movable, which is axially supported with its end away from the binding area 9 in the same manner by means of damping absorbers 13 and 14 on a damping element 12.

On the binding area 9, on the snow-ski board top side 5, a binding plate 15 is anchored, which serves to fasten the binding or binding elements (not depicted) and for this purpose is provided with corresponding fastening means, for example threaded holes, namely in the depicted embodiment with the fastening means 16 or threaded holes for a front binding element and with fastening means 17 or threaded holes for a rear binding element. The trimming rods 11 extend with their end facing away from the shovel area 2.1 and the rear area 2.2, respectively, approximately to the middle area of the binding plate 15, i.e. to an area between the fastening means 16 and 17, and are axially supported there on a support element 18.1 and 19.1, respectively. The support element 18.1 is provided jointly for both of the trimming rods 11 in the front area of the ski, i.e. for the trimming rods 11 extending between the binding area 9 and the shovel area 2.1. The support element 19.1 is allocated to the trimming rod 11, which extends between the binding area 9 and the rear snow-ski board end 2.2.

Both support elements 18.1 and 19.1 are part of a respective tensioning mechanism 18 and 19, which comprise as tensioning elements a respective wedge 18.2 and 19.2, which is movable in an axis direction perpendicular to the longitudinal axis L and parallel to the plane of the running surface 3 by means of a tension screw 18.3 and 19.3 and bears with a wedge surface against a wedge surface of the corresponding support element 18.1 and 19.1, so that by adjusting the respective wedge 18.2 and 19.2, the mechanical axial compressive force of the pressure rods 11 bearing against the support element 18.1 and 19.1 can be increased or decreased.

In the binding plate 15, a guide 20 and 21 is provided for each tensioning direction 18 and 19, respectively. In the guide 20, the support element 18.1 is guided movably in the direction of the longitudinal axis L and the wedge 18.3 is guided movably supported on the binding plate 15 perpendicular to the longitudinal extension and parallel to the plane of the running surface 3. Analogously, in the guide 21, the support element 19.1 is guided in the direction of the longitudinal axis L and the tension wedge 19.2 perpendicular to the latter and supported on the binding plate 15. The two tension screws 18.3 and 19.3 are supported with their heads on the binding plate and engage with their threads in an inner thread of the tension wedges 18.2 and 19.2, and the respective tension screws 18.3 and 19.3 can be accessed by an adjusting tool, for example a screwdriver, through an opening on a longitudinal side of the binding plate 15 or of the snow-ski board body 2.

The elements of the tensioning mechanisms 18 and 19 are made for example of metal or of a suitable plastic. The binding plate 15 is made for example of metal or of a suitable plastic.

The tensioning mechanism 18, the trimming rods 11, the two damping elements 12 and the damping absorbers 13 and 14 form a front trimming mechanism 22. Analogously, the tensioning mechanism 19, the trimming rod 10, the damping element 12 and the corresponding damping absorbers form a rear trimming mechanism 23. The special characteristic is that the tensioning and adjusting mechanisms 18 and 19 are provided separately for the two trimming mechanisms, therefore making it possible to adjust the properties of the snow-ski board body 2 in the front and rear areas independently of each other, i.e. individually. A further special characteristic is that the tensioning mechanisms 18 and 19 are provided in the binding area 9 or on the binding plate 15, namely between the front and rear binding element and therefore, when the snow-ski board is in use, beneath the ski boot. This results in a very simplified and in particular also reliable design of the trimming mechanisms 21 and 23, since the binding plate 15 can be used as a support for the elements of the adjusting or tensioning mechanism 18 and 19 and, when in use, these tensioning mechanisms are protected beneath the sole of the ski boot. To prevent penetration of snow and water, the binding plate is designed so that the guides 20 and 21 are sealed toward the outside and only the heads of the adjusting screws 18.3 and 19.3 supported on the binding plate 15 are accessible by an adjusting tool (e.g. screwdriver) through openings that preferably can be closed. To achieve the maximum trimming effect, the trimming rods 11 are provided above a neutral zone of the snow-ski board body 2, i.e. above a zone in which no or essentially no mechanical tensile or compressive forces occur during bending or flexing of the snow-ski board body 2.

The invention was described above based on an exemplary embodiment. It goes without saying that numerous modifications and variations are possible, without abandoning the underlying inventive idea upon which the invention is based.

It was assumed above that the damping elements 12 are preformed parts made of an elastic damping material, for example elastomer. However, other elastic or damping elements can also be used as the damping elements 12, such as spring elements, e.g. compression springs.

REFERENCE LIST

1 snow-ski board
2 snow-ski board body
2.1 shovel area
2.2 rear end of snow-ski board body
3 running surface
4 core
5 top side
6 longitudinal sides
7, 8 protrusion on top side 5
9 binding area
10 channel
11 trimming rod
12 damping element
13, 14 damping absorber
14.1, 14.2 section
15 binding plate
16, 17 fastening means
18, 19 tensioning or adjusting mechanism
18.1, 19.1 support element
18.2, 19.2 tension element or wedge
18.3, 19.3 tension screw
20, 21 guide
22, 23 trimming mechanism
L snow-ski board longitudinal extension

The invention claimed is:

1. A snow-ski board comprising:

a binding plate fastened to a ski-board body, the ski-board body including at least one trimming mechanism comprising at least one dampening element;

at least one trimming rod extending from the binding plate with an axis oriented in the longitudinal direction (L) of the snow-ski board and acting on the dampening element upon axial movement of the at least one trimming rod and;

at least one tensioning mechanism for supporting the at least one trimming rod on both ends by adjustable mechanical tension, wherein the at least one tensioning mechanism is provided on the binding plate and provides for adjustable axial support of one end of the at least one trimming rod on the binding plate;

wherein the at least one trimming rod is supported on an end away from the binding plate on the at least one damping element and in an area of the binding plate on a support element of the at least one tensioning mechanism by means of at least one further functional element of the trimming mechanism.

2. The snow-ski board according to claim 1, wherein the binding plate is for fastening a front and a rear binding element.

3. The snow-ski board according to claim 1, wherein the at least one trimming rod is accommodated so it is axially movable in a channel formed in the ski-board body.

4. The snow-ski board according to claim 1, wherein the at least one trimming rod is supported on the end away from the binding plate on a support element on the ski-board body by means of at least one further functional element.

5. The snow-ski board according to claim 1, wherein the at least one trimming rod is supported on an end adjacent to the binding plate by means of the at least one damping element by means of at least one further functional element of the trimming mechanism.

6. The snow-ski board according to claim 1, wherein the at least one tensioning mechanism comprises a support element guided in the binding plate in a direction of the snow-ski board longitudinal axis (L).

7. The snow-ski board according to claim 1, wherein the at least one tensioning mechanism comprises a wedge tensioning element.

8. The snow-ski board according to claim 1, further comprising at least two trimming mechanisms, one of which is provided in a front area of the ski-board body between the binding plate and a front snow-ski board end and a further trimming mechanism in a rear area of the ski-board body between the binding plate and a rear snow-ski board body end.

9. The snow-ski according to claim 1, wherein the at least one trimming mechanism comprises at least two mutually offset trimming rods.

10. The snow-ski board according to claim 1, wherein the at least one trimming mechanism and its functional elements are completely accommodated within the ski-board body.

11. The snow ski-board according to claim 1, wherein the at least one trimming rod is completely accommodated within the snow-ski board body.

12. The snow-ski board according to claim 8, wherein the at least two trimming rods are arranged with their longitudinal extension above or below a neutral zone of the ski-board body.

13. The snow-ski board according to claim 9, wherein a joint tensioning mechanism is provided for the at least two trimming rods.

14. The snow-ski board according to claim 12, wherein the at least two trimming rods are arranged along their entire length above the neutral zone of the ski-board body.

* * * * *